United States Patent [19]

Ito

[11] 4,262,077

[45] Apr. 14, 1981

[54] DRY MAGNETIC PRESSURE-FIXABLE DEVELOPING POWDER

[75] Inventor: Jack J. Ito, St. Paul, Minn.

[73] Assignee: Minnesota Mining and Manufacturing Company, St. Paul, Minn.

[21] Appl. No.: 51,885

[22] Filed: Jun. 25, 1979

[51] Int. Cl.[3] ..... G03G 9/00

[52] U.S. Cl. ..... 430/107; 430/108; 430/109; 430/110; 430/111; 252/62.54

[58] Field of Search ..... 430/109, 903, 904, 111, 430/107, 108, 110; 252/62.54

[56] References Cited

U.S. PATENT DOCUMENTS

| | | | |
|---|---|---|---|
| Re. 25,136 | 3/1962 | Carlson | 430/109 |
| 3,840,464 | 10/1974 | Van Engeland | 430/109 |
| 3,947,370 | 3/1976 | Miller | 430/903 |
| 3,974,078 | 8/1976 | Crystal | 430/109 |
| 4,108,653 | 8/1978 | Peters | 430/109 |

*Primary Examiner*—Mary F. Downey

*Attorney, Agent, or Firm*—Cruzan Alexander; Donald M. Sell; Gerald F. Chernivec

[57] ABSTRACT

A flowable, pressure-fixable, magnetic, dry toner powder comprising from about 25 to about 70 percent by weight of a binder material, said binder material comprising a mixture of a polystyrene and a polyolefin/vinyl acetate copolymer, from about 30 to about 75 percent by weight of a magnetically permeable material, and from about 0.5 to about 2.0 percent by weight of conductive carbon.

9 Claims, No Drawings

DRY MAGNETIC PRESSURE-FIXABLE DEVELOPING POWDER

BACKGROUND OF THE INVENTION

This invention relates to a magnetic dry ink powder suitable for use in electrophotographic recording. More particularly, the invention relates to a magnetic developing powder which is pressure responsive such that it can be fixed as an imaging material to an image-bearing surface solely by the application of pressure.

Known developing powders, i.e., dry toner formulations used in electrophotographic recording processes are typically permanently affixed to a copy by means of heat. An exemplary powder is described in Nelson, U.S. Pat. No. 3,639,245 wherein the powder is described as being thermoplastic and heat-fusible. Such heat-fusible powders are fixed after image formation by elevating the temperature of the powder to its melting or softening point, thereby causing the particles to coalesce, flow together and adhere permanently to the substrate.

Although such dry heat-fusing developable powders have been widely used and have met with commercial success, there have been certain disadvantages inherent in the use thereof, such disadvantages relating to speed and efficiency of the fixing process, image quality, etc.

Accordingly, a number of patents have issued which disclose the use of dry pressure-fixable developing powders to overcome these aforementioned deficiencies. For example, see U.S. Pat. Nos. 3,965,022 and 3,775,326 which both relate to pressure-fixing powders.

Such powders are generally soft and thus susceptable to humidity and temperature stability problems. Furthermore, the softness of these powders can result in lower image quality due to background toning or scumming.

When the resultant imaged substrate is simply used as a copy, the foregoing deficiencies may not be a tremendous problem. However, when the imaged substrate is utilized as a printing plate in subsequent conventional offset lithography, the foregoing problems can be detrimental. In this situation, the fixed toner must of course be ink receptive, since such is used as the inked image area. Furthermore, the image must be of high density so as to provide high contrast to the copies prepared by lithography.

I have now discovered a simple combination of materials capable of providing a dry magnetic toner powder which is pressure-fixable and which can be utilized as the image areas of a conventional offset lithographic printing plate.

SUMMARY OF THE INVENTION

In accordance with the invention, there is provided a flowable, pressure-fixable, magnetic, dry toner powder comprising from about 30 to about 75 percent by weight of a magnetically permeable material, from about 0.5 to about 2.0 percent by weight conductive carbon, and from about 25 to about 70 percent by weight of a binder, the binder being comprised of from about 2.0 to about 30 percent by weight of a polyolefin/vinyl acetate copolymer and from about 70 to about 98 percent by weight polystyrene.

When this toner powder is electrophotographically imaged onto an appropriate receptor and pressure fixed, the imaged receptor can provide a lithographic offset printing plate capable of extended press life.

DETAILED DESCRIPTION OF THE INVENTION

My invention relates to the discovery that I can produce a dry pressure fixing magnetic toner powder for electrophotographic imaging utilizing, as a binder, a ployolefin/vinyl acetate copolymer together with a polystyrene carrier resin.

As to the polyolefin/vinyl acetate copolymer, I have determined that the vinyl acetate portion thereof can range from about 4 to about 50 percent by weight of the polymer composition itself, with the equivalent melt indices (in grams per ten minutes) ranging from about 3.6 to about 70. An exemplary and preferred copolymer is polyethylene/vinyl acetate.

As for the polystyrene component, materials having an average molecular weight of from about 1,000 to about 100,000 are capable of functioning satisfactorily in my invention.

The binder should typically contain from about 2.0 percent by weight to about 30 percent by weight of the copolymer, the balance, of course, being polystyrene with from about 10.0 to about 25 percent by weight copolymer being preferred. At as low a copolymer concentration of 2.0 percent by weight, improvement in press life of the imaged plate is noted. Increasing the copolymer concentration in the binder causes an increase in press life, until other factors, such as processability in manufacture, relative humidity effects, etc., are encountered, typically at a copolymer concentration of greater than about 30 percent by weight of binder.

Also incorporated in or on the binder particles of my toner powder are magnetically permeable particles, typically having an average major dimension of one micron or less. Exemplary materials include magnetite, barrium ferrite, nickel zinc ferrite, chromium oxide, and nickel oxide. The magnetic particles should comprise from about 30 to about 75 percent by weight of the toner powder, with a preferred range of between 50 and 65 percent by weight.

Also, sufficient conductive carbon should be included in the toner powder composition to provide the desired conductivity to the toner powder. Conductivity depends on the receptor utilized, the type of imaging equipment, etc. Generally, however, from about 0.5 to about 2.0 percent by weight of the toner powder is typically conductive carbon.

Various other materials may be desirably and conventionally incorporated in or on the toner powder particles of my invention, e.g., antioxidents, and flow agents can be added to the dry particles to improve their powder characteristics. Exemplary antioxidants include Irganox 1010, commercially available from Ciba-Geigy, Ionox 330 from Shell, and Ethyl 702 from Ehtyl Corporation.

Exemplary flow agents include fatty acid amides, e.g., Kenamides from Kraftco Corporation, and fumed silicas, e.g., Cab-o-sil from Cabot.

The developing powder of my invention is prepared by initially obtaining a blend of the appropriate composition by any of several conventional techniques. For example, the binder components, i.e., the polystyrene and copolymer, may be placed on a rubber mill, the rolls of which may be heated to facilitate mixing, and then the magnetic particles, along with fillers, etc., can be added and dispersed. The mixture is then allowed to cool, after which it is ground and classified in accordance with an appropriate number average particle size range of about 5 to about 40 microns.

Alternatively, the binder may be dissolved in a suitable solvent or solvent mixture, following which fillers may be added to the solution, which becomes concentrated with concurrent agitation until the dispersion becomes sufficiently thick to prevent filler settling, following which the dispersion may be dried, ground and classified as above.

The binder components may also be dissolved in an appropriate solvent or solvent mixture, which can then be removed to yield a dry binder blend to which the magnetic particles and other fillers may be added, as in a heated Banbury mixer, rubber mill, or other appropriate high intensity mixer well known to those skilled in the art. After cooling, the dispersion can be again ground and classified.

The solid particles obtained in accordance with any of the foregoing procedures may be then "spheroidized," if necessary, by the following method. The power is aspirated into a moving gas stream, preferably air, to create an aerosol. This aerosol is directed perpendicular to and through a stream of hot air, which has been heated to about 1000° F., in a cooling chamber where the powder is then allowed to settle by gravity while it cools. The resulting powder now comprises substantially spheroidal particles.

Conductive carbon may be attached to the particle surfaces during this spheroidizing step by including the carbon particles with the toner powder when same are directed through the stream of hot air.

Alternatively, carbon may also be attached to the toner particle surface by blending the toner particles and conductive carbon in a mechanical blender such as the Patterson-Kelly elbow blender. The blender is placed in a forced air over at an appropriate temperature, wherein the carbon becomes attached to the surface of the thermally softened toner particles.

Of course, conductive carbon may also be dispersed in the bulk of the toner particles.

The toner particles can be optionally blended with a flow agent to insure that the developer powder will be free flowing. Typical flow agents include fumed silica and fatty acid amides, e.g., Kenamides from Kraftco Corporation. The amides are applied through a solution process, wherein a slurry of toner particles are treated with a solution of the amide.

The toner powder of my invention can be used with conventional and commercially available electrophotographic imaging techniques, an exemplary one being that disclosed in U.S. Pat. No. 3,909,258.

Substrates capable of being imaged, and subsequently utilized as a lithographic offset plate, are also conventional, and include surfaces such as selenium, cadmium sulfide, organic materials such as polyvinyl carbazole, etc. A preferred substrate is disclosed in assignee's copending Application Ser. No. 22,874, filed Mar. 22, 1979, and comprises an electrically conductive support having a resinous layer thereon and a photoconductor coating overlying the resinous layer. The major component of the resinous layer is a resin selected from polyurethanes, acrylics, acrylate copolymers, polysulfones and polyvinyl acetates. The support thereof can typically be paper, and the photoconductive layer typically comprises zinc oxide dispersed in an insulating binder.

My invention will now be more specifically described by the use of the following non-limiting examples, wherein all parts are by weight unless otherwise specified. In all instances, press runs were undertaken on a Multilith 1250 Printing Press.

EXAMPLE 1

To begin preparation of the toner powder of my invention, a conventional 2-roll rubber mill was brought to 320° F., following which seven parts of polystyrene, having the molecular weight of about 2,000, was placed thereon. Once the polystyrene was melted in, 1.0 part of Ultrathene UE634, tradename for a 28 percent by weight vinyl acetate/polyethylene copolymer having a melt index of 6.0, and commercially available from U.S.I. Chemicals was placed on the rubber mill and thoroughly blended with the polystyrene. Following thorough blending, 12.0 parts of sub-micron sized magnetite was added and thoroughly blended by varying the shear rates for a period of thirty minutes.

The material on the mill was then sheeted and flaked by cooling the mill rolls with cold water. The material was then ground to a smaller size using a conventional laboratory grinder, the composition being chilled with dry ice prior to grinding. Final grinding, to an Alpine classification of from about 5 to about 40 microns in size, was undertaken utilizing a conventional hammer mill.

Following this, 0.17 parts of conductive carbon were attached to the toner powder particle surface by hot blending same with a Patterson-Kelly elbow blender.

To provide imaging, an electrophotographic receptor as described in commonly assigned and copending application Ser. No. 22,874 was prepared utilizing a commercially available paper known as "electrostatic offset master base" paper, which was obtained from Allied Paper Corporation. This was coated, at a dry coating weight of 5 grams per square per meter, with a urethane polymer composition, comprising 175 parts of the reaction product of polycaprolactone diol, neopentyl glycol, and 4, 4'-diphenyl methane, diisocyanate, 6 parts of carbon black, and 145 parts of methyl ethyl ketone. Over this urethane composition was applied a zinc oxide/resin binder/dye sensitizer photoconductive layer at - dry weight approximating 32 grams per square meter. The photoconductive zinc oxide material was prepared by dispersing, until a Hegman grind of 5–6 (NS scale) was achieved, 79.2 parts toluene, 35.2 parts of a 50 percent solids 690X300 acrylic resin from DeSoto, Inc., 105.6 parts of Zinc Oxide, 345-PC from St. Joe Minerals Corporation, and 5.3 parts of a 6 percent by weight solution of Rhodamine B dye in methanol.

This substrate was then imaged with my toner powder on an MR1135 Electrophotographic Imaging machine commercially available from the 3M Company. When the resultant printing plate was mounted on the Multilith 1250 Press, a press life in excess of 4,000 copies was obtained.

When the same plate was prepared utilizing a commercially available toner powder, a press run of only 900 copies was obtained.

EXAMPLE 2

Example 1 was duplicated with the exception that the copolymer concentration was increased to 2 parts whereupon, a press life in excess of 4,000 copies was obtained.

EXAMPLE 3

Example 1 was duplicated with the exception that the polystyrene of example 1 was eliminated and Piccolastic D-125, a polystyrene having a molecular weight of about 28,000 was utilized.

When processed as per example 1, a press life in excess of 2,200 copies was obtained.

EXAMPLE 4

Example 1 was duplicated, with the exception that EY-902-30, tradename for a polyethylene/vinyl acetate copolymer containing 40 percent by weight vinyl acetate, having a melt index of 70.0, and commercially available from U.S.I. Chemicals, was utilized.

When processed and operated in conjunction with the Multilith 1250 Press, a press life in excess of 4,000 copies was obtained.

What is claimed is:

1. A flowable, magnetic, pressure-fixable, dry toner powder suitable for development of electrophotographically-produced images, said powder comprising from about 25 to about 70 percent by weight of a binder component, said binder component comprising a mixture of polystyrene and a polyolefin/vinyl acetate copolymer, from about 30 to about 75 percent by weight of a magnetically permeable material, and from about 0.5 to about 2.0 percent by weight of conductive carbon.

2. The powder of claim 1 wherein said polyolefin/-vinly acetate copolymer comprises from about 2 to about 30 percent by weight of said binder, and said polystyrene comprises from about 70 to about 98 percent by weight of said binder.

3. The powder of claim 1 wherein said binder comprises from about 10.0 to about 25 percent by weight of polyolefin/vinyl acetate copolymer and from about 75 to about 90 percent by weight polystyrene.

4. The powder of claim 1 wherein said polyolefin/vinyl acetate copolymer contains about 4 to about 50 percent by weight vinyl acetate.

5. The powder of claim 1 wherein said polyolefin/vinyl acetate copolymer has a melt index of from about 3.6 to about 70.

6. The powder of claim 1 wherein said polyolefin/vinyl acetate copolymer is a polyethylene/vinyl acetate copolymer.

7. The powder of claim 1 wherein said polystyrene has an average molecular weight of from about 1,000 to about 100,000.

8. The powder of claim 1 wherein said magnetically permeable material comprises from about 50 to about 65 percent by weight of said powder, and said binder comprises from about 35 to about 50 percent by weight of said powder.

9. The powder of claim 1 wherein said powder has a number average particle size of from about 5 to about 40 microns.

* * * * *